United States Patent [19]

Takeda et al.

[11] Patent Number: 4,470,288

[45] Date of Patent: Sep. 11, 1984

[54] MANUFACTURING METHOD AND APPARATUS FOR SHELL OF UNIVERSAL-JOINT

[75] Inventors: Koichi Takeda, Okazaki; Sadao Ikeda, Toyota; Koichi Matsubara, Nagoya, all of Japan

[73] Assignee: Toyota Jidosha Kabushiki Kaisha, Aichi, Japan

[21] Appl. No.: 412,088

[22] Filed: Aug. 27, 1982

[30] Foreign Application Priority Data

Sep. 11, 1981 [JP] Japan ..... 56-144116

[51] Int. Cl.[3] ..... B21K 21/08

[52] U.S. Cl. ..... 72/370; 72/402

[58] Field of Search ..... 72/367, 370, 402, 401; 464/111

[56] References Cited

U.S. PATENT DOCUMENTS

| | | | |
|---|---|---|---|
| 2,151,568 | 3/1939 | Sinclair | 228/144 |
| 3,792,596 | 2/1974 | Orain | 464/111 |
| 4,143,533 | 3/1979 | Bosch | 72/68 |
| 4,319,478 | 3/1982 | Yoshioka | 72/306 |
| 4,381,659 | 5/1983 | Welch et al. | 72/370 |

FOREIGN PATENT DOCUMENTS

| | | | |
|---|---|---|---|
| 62067 | 7/1981 | European Pat. Off. . | |
| 2839625 | 3/1979 | Fed. Rep. of Germany . | |
| 10430 | 3/1974 | Japan | 72/402 |
| 30548 | 3/1980 | Japan | 72/367 |
| 144361 | 4/1931 | Switzerland | 72/402 |

*Primary Examiner*—Lowell A. Larson

*Attorney, Agent, or Firm*—Parkhurst & Oliff

[57] ABSTRACT

Manufacturing method for a tubular shell of a constant velocity universal-joint for flexibly coupling two rotary shafts, to one of which the shell is fixed at a flange thereof. The method comprises a groove and preliminary flange forming process and a flange forming process. In the former process a hollow cylindrical blank is applied pressing in a radial direction for forming plural grooves therein and forming at the same time a preliminary flange at one end of the cylindrical blank by expanding it into a funnel shape, and in the latter process the preliminary flange formed on a semi-finished article in the former process is formed into a completed flange by a flange forming die, while holding the semi-finished article in a restrained status under pressure from either side, external and internal, by means of restraining dies. An apparatus suitable for performing the method is also disclosed.

8 Claims, 9 Drawing Figures

MANUFACTURING METHOD AND APPARATUS FOR SHELL OF UNIVERSAL-JOINT

BACKGROUND OF THE INVENTION

This invention relates to a method of manufacturing a shell for a universal-joint and an apparatus therefor, and more particularly to that when a shell is made by press forming process.

As a species of universal-joints for flexibly joining a pair of rotary shafts, one is known wherein a tubular shell having a flange on one end thereof is secured at the flange to one of the rotary shafts and the other rotary shaft is inserted inside the shell for being engaged, through a plurality of engaging members disposed at the inserted end thereof, with a plurality of grooves axially extended inside the shell so that the pair of rotary shafts can be rotatably connected.

In some universal-joints belonging to this category, a shell has been conventionally manufactured by forming a hollow cylindrical material or blank of thick wall through extrusion such as hot forging or cold forging, followed by a forging process applied on the thick walled material with a punch and a die and a machining process for forming the grooves to a desired shape and dimension.

The above-mentioned manufacturing method is problematical in various respects, for example, being low in productivity because of its laborious and time-consuming process of machining when finished, consequent cost rising, or deterioration of strength of the products because of machining or cutting of the material after the forging.

Adoption of the forging process which is inherently required to be large in the wall-thickness inevitably makes the products to be thick-walled in the above-mentioned method, which necessitates the products heavy and expensive in material cost, to a great disadvantage.

The above-described disadvantage inherent to the shell manufacturing method is due to the manufacturing method depending on forging and the consequent machining. The Inventors of this invention then thought of an idea before to manufacture the shell from a thin walled cylindrical material or blank by means of applying a press forming process thereon. An application for patent to a completed method for this purpose after a series of studies and experiments in respect of concrete conditions and required order of processes was filed with the Japanese Patent Office with the Serial No. TOKU-GAN-SHO-55(1980)-69499, on which was filed an International Patent Application No. PCT/JP81/00079 which was published as WO No. 81/03294, and on which an European Patent Application No. 81 900 944.0 was filed on Jan. 21, 1982, and a U.S. patent application Ser. No. 342,010 on Jan. 15, 1982. The gist of that invention resided in applying a preliminary pressing process on a cylindrical material so as to form a plurality of grooves extended in an axial direction and also applying simultaneously or thereafter an ironing process along the longitudinal grooves so that the grooves may be finished into desired dimension and shape.

This method was not perfect because of including two kinds of processes, namely the pressing process and the ironing process, which naturally necessitated respectively different sets of dies and required double man-hours.

SUMMARY OF THE INVENTION

A principal object of the present invention is, therefore, to provide an improved manufacturing method, wherein the grooves of a shell having a flange on one end thereof can be formed, by merely applying a pressing process on a hollow cylindrical blank, into desired shape and dimension.

Another object of the invention is to provide an apparatus suitable for performing the above-mentioned method.

The present invention completed in this way, i.e., a manufacturing method of a tubular shell for a universal-joint for flexibly joining a first rotary shaft to a second rotary shaft, wherein the shell having a flange at one end thereof is secured at the flange to the first rotary shaft, and is provided at suitable places inside with a plurality of grooves extended along the axis thereof for being engaged with plural engaging members disposed on one end of the second rotary, shaft which is inserted from the other end of the shell, is characterized in comprising (1) a process of groove formation wherein a hollow cylindrical blank or material is applied pressing in a radial direction so as to form the grooves and simultaneously form a preliminary flange by expanding one end of the cylindrical blank into a funnel shape, and (2) a process of flange formation wherein the preliminary formed flange is formed into a completed flange, while the semi-finished article made in the previous groove forming process is kept in a restrained status under pressure by means of restraining dies placed on either side, external and internal.

In this method, the ironing process, which was essential in the previous invention, already filed for requesting a patent as stated before, could be eliminated while completely maintaining the merits of that invention, viz. reducing the weight of the finished article and reducing the material cost because of manufacturing a shell from a cylindrical material of thin wall and enhancing the strength and rigidity of the article because of eliminating the machining process. The just mentioned doing away of the ironing contributes a great deal to further reducing the man-hour, labor and cost.

According to the present invention there is also provided an apparatus suitable for the above-mentioned method. The apparatus is characterized by comprising a groove and preliminary flange forming apparatus and a flange forming apparatus and a flange forming apparatus. The former comprises (1) a first die to be inserted inside a hollow cylindrical blank and having a plurality of axially elongated recesses formed on an external circumference thereof with an equal interangular distance and a plurality of non-recessed portions remained between each adjacent pair of the recesses, circumferential configuration of the first die being corresponding to internal configuration of a shell to be manufactured, (2) a second die consisting of a plural die blocks radially arranged to surround the first die, the die blocks being radially movable and defining a space corresponding to an external configuration of the shell at the most inwardly advanced position thereof, (3) a preliminary flange forming die of a funnel shape convergent from a fixed end to a free end thereof which is axially movable, and (4) actuating means for simultaneously advancing the die blocks and the preliminary flange forming die to make the former urge a side wall of the blank to the first die and to simultaneously make the latter expand one end of the blank to a preliminary flange of funnel shape for making the blank into a semi-finished article.

On the other hand the flange forming apparatus comprises (1) restraining dies holding the semi-finished article in a restrained status under pressure from either side, external and internal, at a portion except the preliminary flange thereof, and (2) a flange forming die having a flat surface axially urged to the preliminary flange for forming the same into a completed flange perpendicular to the axis of the shell.

In a preferable embodiment of the present invention the first and second dies of the groove and preliminary flange forming apparatus may serve as the restraining dies of the flange forming apparatus.

The method and apparatus of manufacturing a shell of this invention will be described further in detail taking an example of one for a universal-joint used in a vehicle, which shell connects a differential side gear shaft and a countershaft for transmitting the rotation motion of the former, with reference to the appended drawing.

DETAILED DESCRIPTION OF THE PREFERRED EMBODIMENTS

An example of a shell to be manufactured in accordance with this invention will be explained first with reference to FIG. 1 before entering the description of the manufacturing method.

Figure 1:
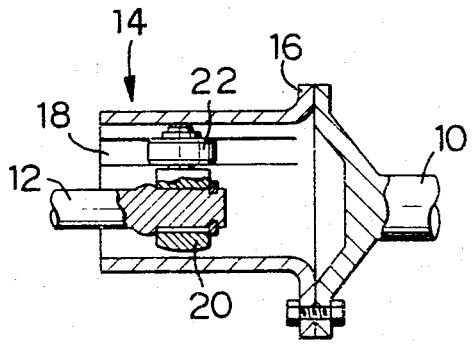
FIG. 1 is an axial sectional view, in elevation, of one example of a universal-joint to which the present invention is to be applied.
Figure 2:
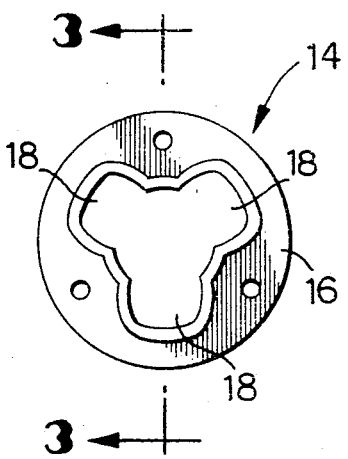
FIG. 2 is a cross-sectional view of the shell in FIG. 1.
Figure 3:
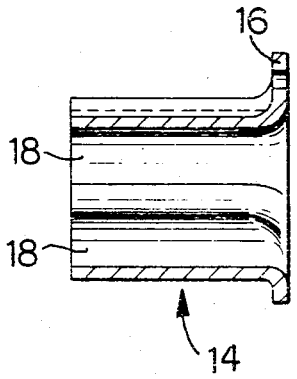
FIG. 3 is an elevational sectional view of the shell in FIG. 1.

In FIGS. 1–3 a universal-joint of tripod type secured on a differential side gear shaft 10 for transmitting rotation thereof to a countershaft 12 is illustrated. A shell 14 is a tubular body open on either end, being connected at one end thereof having a flange 16 with the shaft 10 by means of bolts. The shell 14 is provided on the internal side thereof with three parallel grooves 18 extending along the axis thereof. A fixed member 20 secured on the end portion of the countershaft 12 is adapted to be engaged with the grooves 18 by way of three rollers 22.

Manufacturing method of the shell for the universal-joint having such a construction will be roughly described with reference to FIG. 4(A). First of all a hollow cylindrical blank or material 24, being almost equal in its wall-thickness and outer diameter to a finished article, is prepared. The material 24 is applied a press process, with a later described apparatus, in a radial direction thereof, so as to render the wall thereof inwardly protrude at three places, with a consequent result of forming three parallel grooves 18 having a 120° angular distance between every two neighboring ones. This constitutes a first passage (I). In this press process of forming the groove 18 the material is made into a piece having the same required dimension and shape as a finished article, that is to say, those conditions necessary for a finished shell. Along with this groove forming first process (I) a preliminary flange forming process for a flange 16 is executed. A preliminary formed flange 26 with a funnel shape radially extended at one end of the cylindrical material or blank is made in this process to be a semi-finished article 28.

A proper flange formation process is applied as a continuous process on the semi-finished article 28 so as to make the preliminary flange 26 of funnel shape to be further expanded in a perpendicular direction to the axis. During the course of this process the tubular portion of the material including the grooves 18 is held in a restrained status under pressure from either the external and internal side thereof for the purpose of preventing deformation of the grooves 18 already finished to a desired dimension and shape in the first process (I). An article 30 thus obtained in such a flange formation process (II) is provided with a desired dimension and shape as a shell for a universal-joint. It can be supplied as it is as a shell for a universal-joint illustrated in FIGS. 1–3. "As it is" referred to herein means only "without doing a finish process to the grooves 18", but is not meant to exclude even simple machining processes such as boring bolt holes or the like.

Figure 4:
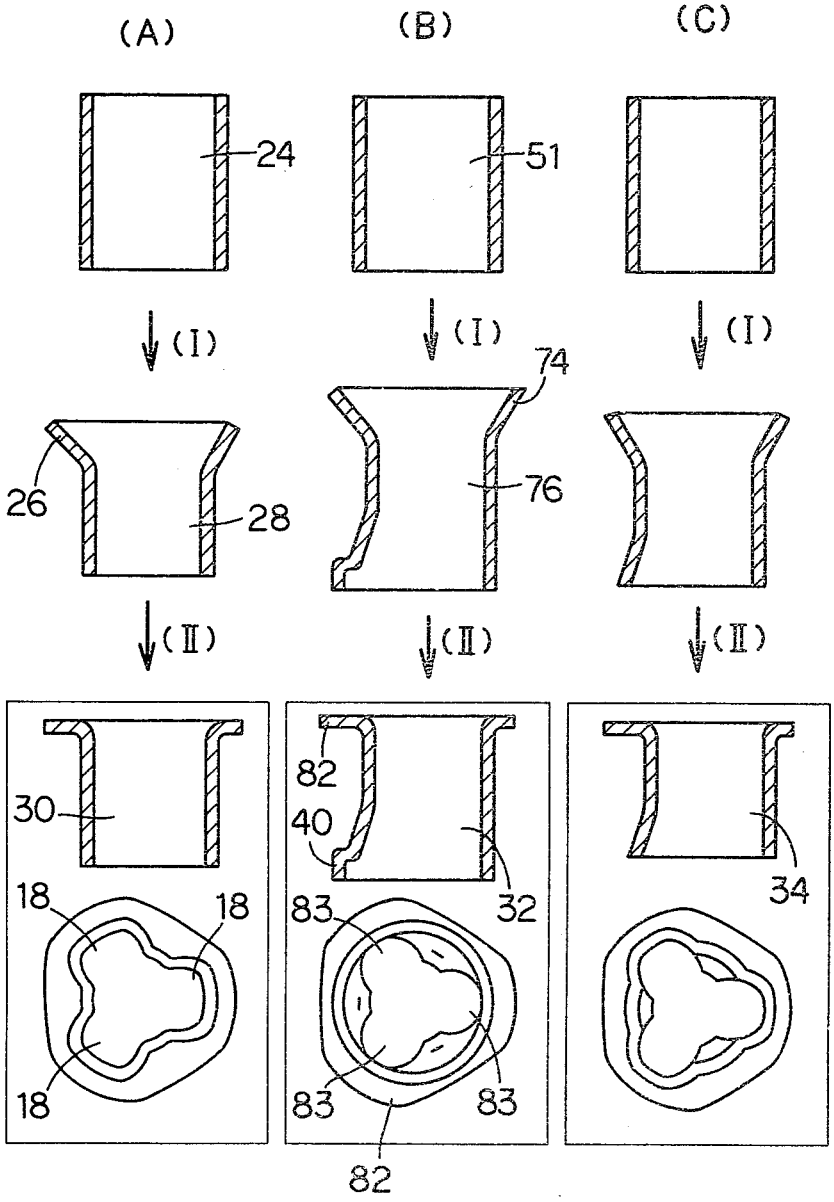
FIGS. 4 (A)–(C) are diagrammatic charts for showing three manufacturing processes according to this invention for each of three kinds of shells of different shape.

Following FIGS. 4(B) and 4(C) respectively illustrate manufacturing processes for two other shells 32, 34 of different shape. The shape of those shells is respectively selected according to the shape of the other rotary shaft, i.e., the countershaft 12 which is to be inserted into the shell for being connected with the differential side gear shaft 10. Since the manufacturing processes for those two kinds of shells 32, 34 are fundamentally similar to that for the shell 30 shown in FIG. 4(A), processes to be taken for the manufacturing of these three kinds of shells and an apparatus therefor will be described hereunder with reference to FIGS. 5–7 by taking up the shell 32 alone as a representative.

Figure 5:
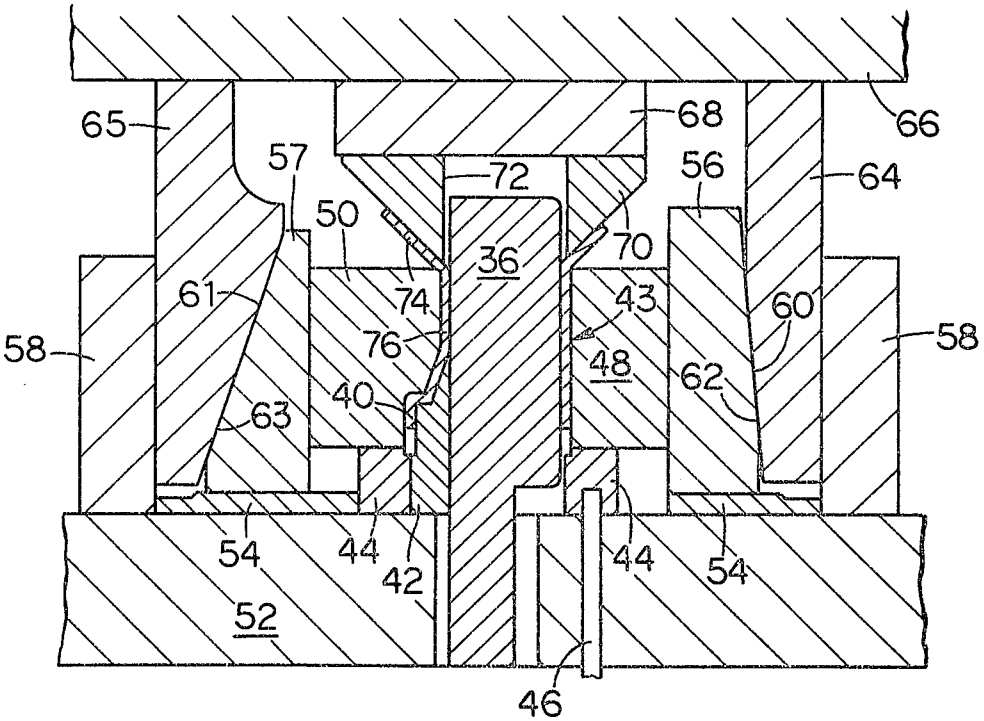
FIG. 5 and FIG. 6 are respectively an elevational sectional view and a cross-sectional view of an apparatus performing the process (I) in FIGS. 4 (A)–(C)
Figure 6:
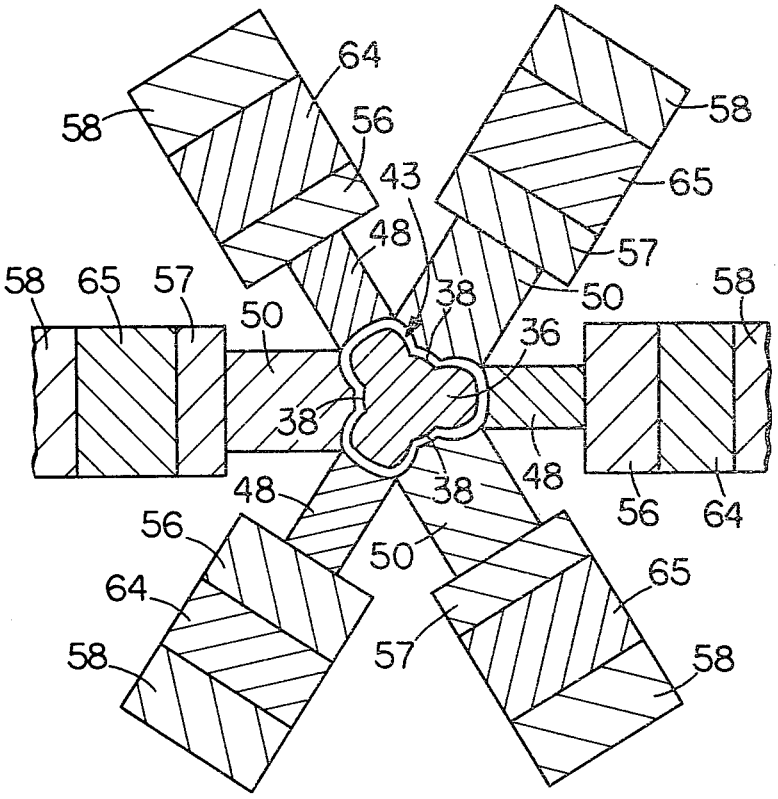

In FIG. 5 showing a groove and preliminary flange forming apparatus, numeral 36 designates a principal punch secured to a punch holder (not shown). The punch 36 is provided at three places on the external circumference thereof, with axially elongated recesses 38 (see FIG. 6) with an equal interangular distance of 120° therebetween. The cross-sectional circumferential configuration of the punch 36 is made suitable for obtaining an article of desired shape, that is to say, made into a shape just corresponding to or in conformity with the cross-sectional internal outline of the shell 32 shown in FIG. 4(B). On each lower portion of the recesses 38 of the punch 36 a sub-punch 42 provided with an external outline corresponding to a cylindrical portion 40 of the shell 32 is secured so as to constitute a punch assembly 43 as a first die together with the principal punch 36 for helping the formation of the main portion of the shell into a certain configuration according to the shape of the countershaft. The sub-punch 42 may be either secured to the principal punch 36 by means of bolts or integrally formed therewith. Along the external circumference of the punch assembly 43 a spacer 44 for sustaining the cylindrical material or glank placed thereon is disposed. And an eject pin 46 is secured to the spacer 44 for pushing upwards the same due to ascending of the eject pin 46. Above the spacer 44 three sets of die blocks constituting a second die are disposed opposing to each other, being radially arranged so as to surround the punch assembly 43. Each principal die block 50 of the set of the die blocks is located facing each recess 38 of the punch 36, and each auxiliary die block 48 is located facing each non-recessed portion of the punch 36. The die block 50 facing the recess 38 is protruded at the middle portion thereof toward the recess 38 for rendering the side wall of the cylindrical material 51 (see FIG. 4(B)) inwardly projecting with the cooperation of the recess 38. The lower portion of the die block 50 which faces the sub-punch 42 is so formed as to correspond to the external outline of the cylindrical portion 40 of the shell 32 so, it is possible to perform press process, likewise the above, on the cylindrical portion 40 and the continuation portion thereof with the aid of the sub-punch 42.

Each of the die blocks 48 and 50 is respectively secured to a movable cam 56 and 57 which are slidable on a sliding base 54 disposed on a lower base 52 such that they are moved together with the movable cams 56, 57 toward or away from the punch assembly 43. The die blocks 48 and 50 define a space corresponding to an external configuration of the shell 32 at the most inwardly advanced position thereof. The movable cams 56, 57 are guided when moved by not-shown guide rods extended from stationary blocks 58 which are position-fixedly disposed outside themselves. They are at the same time biased in a separating direction from the punch assembly 43 (hereinafter called outwardly) by not-shown resilient members of urethane rubber, or springs, for example, which are attached at one end thereof to the stationary blocks 58.

Those movable cams 56, 57 are respectively provided with an inclined cam surface 60, 61 so as to be inwardly moved by cam action caused by a descending movement of complementary cams 64, 65 which are respectively provided with a cam surface 62, 63 so inclined as to be complementary, i.e., slant in the same direction and angle with that of the movable cams. The complementary cams 64, 65 are secured above the movable cams 56, 57 to an upper base 66 for being ascended and descended together with the same. What has to be pointed out in this instance is that the angle formed between the cam surfaces 61, 63 and a vertical plane, i.e., the direction in which the upper base is moved, is made larger than the angle formed by the cam surfaces 60, 62 against the vertical plane. It therefore signifies that the movable cam 57 and the die block 50 are moved or advanced larger than the movable cam 56 and the die block 48 during one descending movement of the upper base 66. The angle formed by the cam surfaces 60, 62 against the vertical plane is preferable to be in the range of 0.03°–10°, and more preferable to be 0.5°–3.0°. On the other hand, the angle formed between the cam surfaces 61, 63 and the vertical plane is preferable to be in the range of 5°–50°, and more preferable to be 10°–45°. Such a difference in the angle formed by the cam surfaces makes it possible to lessen the urging force of the die block 48 than that of the die block 50, and consequently to carry out the groove formation process while holding a portion of the cylindrical material 61 where little deformation is expected under a suitable restraining force.

In the middle portion of the upper base 66 an attaching block 68 is secured, and on the lower side thereof a preliminary flange forming die 70 is secured. The die 70 is provided with an opening 72 for receiving the head of the punch 36 leaving a slight clearance between the two, and it is at the same time tapered to be of funnel shape convergent from the fixed end to the free end thereof.

The earlier mentioned preliminary forming process performed with such an apparatus will be described. A suitably prepared cylindrical material 51 is fitted on the punch assembly 43 before the upper base 66 accompanied by the complementary cams 64, 65 is descended. The movable cams 56, 57 are inwardly moved, under pressure due to the cam action appearing there, resisting the biasing force of the above-mentioned resilient members. Along with this movement the die blocks 48, 50 respectively secured to each of the movable cams 56, 57 are moved inwardly so as to urge the side wall of the cylindrical material 51 inwardly as far as to form grooves of desired shape and dimension as a shell in the cylindrical material 51.

When the upper base 66 is descended the preliminary flange forming die 70 is simultaneously lowered so as to outwardly expand the upper end of the material as widely as approx. 45° to be a preliminary flange 74 of funnel shape. Such a parallel execution of the preliminary flange forming process and the groove forming process makes it possible to form a main portion of the shell 32 having deep grooves 83 and a flange 82 as a continuation from the former, as can be seen in FIG. 4(B). The apparatus shown in FIG. 5 is partially suited to this process, but it does not exclude employment of another apparatus wherein the preliminary flange forming die 70, the die blocks 48, and the die blocks 50 are respectively operated by an independent driving mechanism.

Ensuing lift of the complementary cams 64, 65 together with the upper base 66 will cause ascending of the preliminary flange forming die 70 and the outward retracting of the movable cams 56, 57, owing to the action of the resilient members connected thereto. Subsequent pushing upwards of the spacer 44, due to the action of a not-shown cushion mechanism, via the eject pins 46 causes a semi-finished article 76 to be raised upwards for being taken out of the punch assembly 43. The groove forming process (I) is completed herewith.

Figure 7:
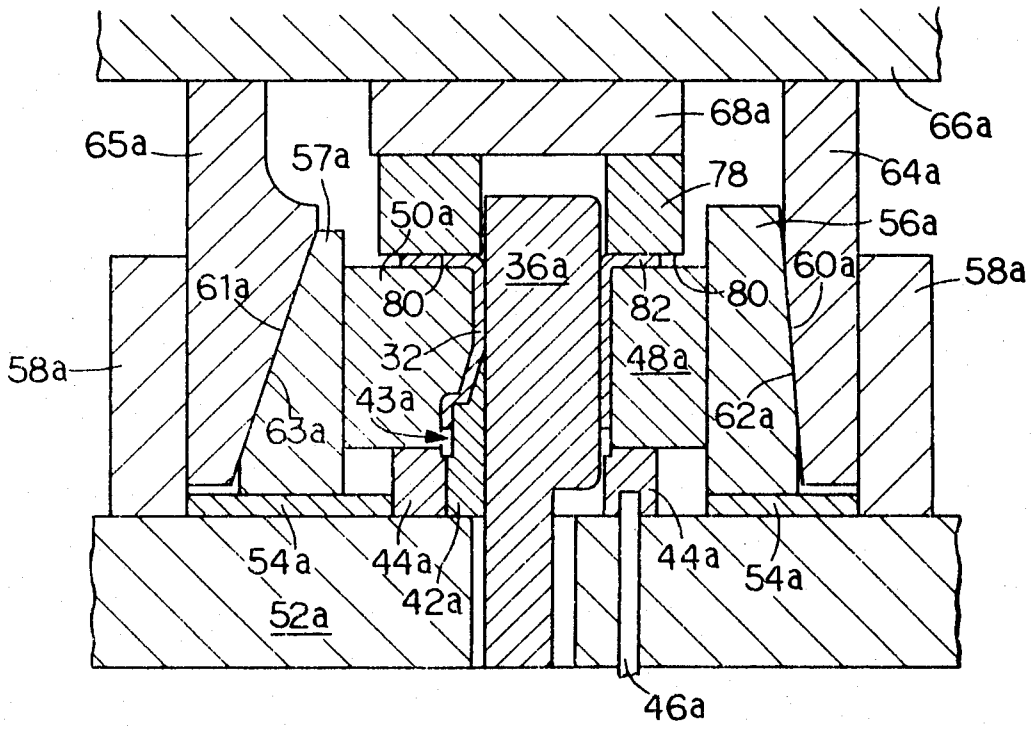
FIG. 7 is an elevational sectional view of an apparatus performing the process (II) in FIGS. 4 (A)–(C).

A flange forming process is applied on the thus obtained semi-finished article 76. This process will be described with reference to FIG. 7, showing a flange forming apparatus, wherein a flange finishing die 78 is employed in place of the preliminary flange forming die 70. A horizontal press surface 80 provided on the flange finishing die 78 is effective in re-forming the preliminary flange 74 into a completed flange 82 perpendicular to the axis of the shell 32. Other parts of this apparatus shown in FIG. 7 are similar to those shown in FIGS. 5 and 6, detailed description being omitted by only assigning a suffix a to the numerals of the corresponding parts.

Although the processes for forming the flange in this apparatus is substantially identical to that in the previously described groove forming process (I), what has to be paid attention is that the punch assembly **43*a*, the die blocks 48*a*, and the die blocks 50*a* do a function of preventing possible deformation of the grooves which have already been formed in the process (I) caused by the flange forming process (II). In other words, while the semi-finished article 76*a*** set on the punch assembly 43*a* is processed by the flange finishing die 78 descended together with the upper base 66*a*, the die blocks 48*a*, the die blocks 50*a* radially surrounding the semi-finished article 76 are approached to the semi-finished article 76 simultaneously with the descending of the upper base 66*a* so as to restrain the same under pressure from both sides thereof, external and internal, with the cooperation of the punch assembly 43*a*. This will effectively prevent possible deformation of the grooves when the flange forming process (II) is carried out. It is also allowable in the process (II) to drive the flange finishing die 78 by an independent drive source from that for the movable cams 56*a*, 57*a*. Another modification of descending the flange finishing die 78 after the semi-finished article 76 has been restrained by the die blocks 48*a* and the die blocks 50*a* is permissible. Besides, it is not necessarily required to differentiate the urging force of the die blocks 48*a* and the die blocks 50*a*.

Lifting of the upper base 66*a* after it has once reached the lower dead point will release the restraining of the finished article 32 by the movable cams 56*a*, 57*a*, the die blocks 48*a*, and the die blocks 50*a* and cause the spacer 44*a* to be raised by the eject pin 46*a*, which pushes upwards the finished article 32 for being taken out of the punch assembly 43*a*. It means the completion of the flange forming process (II).

The above-described method of manufacturing a shell for a universal-joint, in which a shell of thin wall and light in weight is directly obtained by a press process, can maintain the merits of the previous invention such as improvement of material saving due to the thin wall and lightness of the finished articles and enhancing of strength and rigidity of the articles due to elimination of machining, while being characteristically featured in reducing the manufacturing cost through economy of required time and labor coming from the elimination of the ironing process which was essential in the previous invention.

The elimination of the ironing process which had been essential in the previous invention was mainly achieved by strengthening the restraint of the semi-finished article in the flange forming process. In other words, the cam surfaces 60*a*, 62*a* which were vertical in an apparatus of the previous invention are slanted against a vertical plane in the present invention, wherein the semi-finished article 76 is strongly urged onto the punch 36*a* not only by the die blocks 50*a* but also by the die blocks 48*a*, allowing consequently the flange forming process to be carried out while it is fully prevented from buckling along the entire circumferential periphery thereof. This ensures prevention of precision deterioration of the grooves once formed, which eventually allows doing away of the ironing.

Furthermore, the cam surfaces 60, 62 which had traditionally been vertical were altered to be slant to some extent against a vertical plane, in an apparatus employed for the groove forming process, which has changed the protrusion forming process such that the protrusions are formed by the die blocks 50 while the die blocks 48 is held under pressure. It has greatly improved precision in dimension of the groove forming process.

Additionally speaking herewith, the flange forming process in the above embodiment, wherein the flange formation is executed by means of transferring the semi-finished article 76 formed in an apparatus shown in FIG. 5 to another apparatus shown in FIG. 7, can be changed such that only the preliminary flange forming die 70 is lifted, while holding the die blocks 48, 50 at the present position without retracting even after the formation of the groove, and laterally retreated for allowing the flange finishing die 78 to be descended in its place. It signifies, in other words, to utilize the die blocks 48, 50 as a part of a restraining die along with the punch assembly 43.

Figure 8:
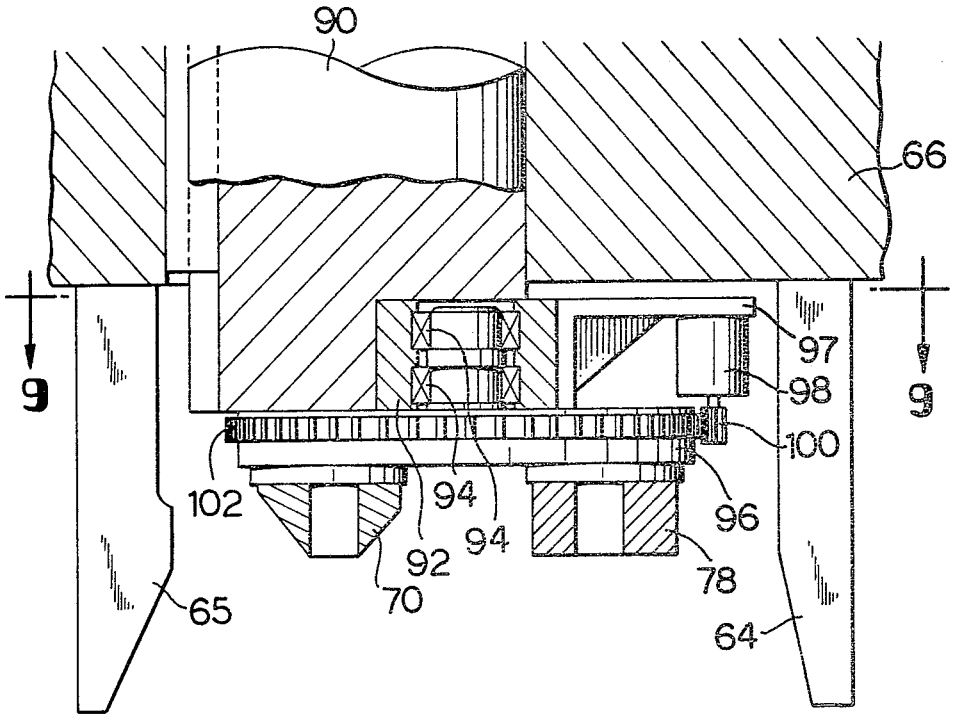
FIG. 8 is an elevational sectional view of a part of an apparatus performing the processes (I) and (II) in FIGS. 4 (A)–(C).
Figure 9:
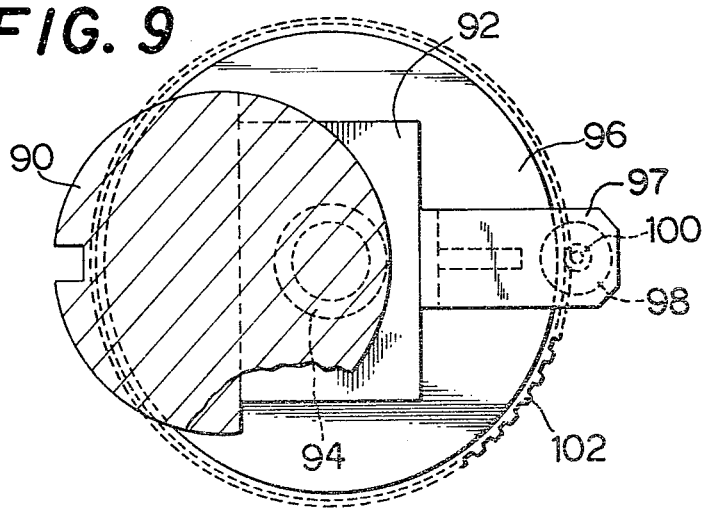
FIG. 9 is a cross-sectional view taken along the line 9—9 in FIG. 8.

This method can be performed by an apparatus, for example, one illustrated in FIGS. 8 and 9, wherein a slider 90 is retained by the aforementioned upper base 66 such that the slider 90 is slidable in a parallel direction to that of the movement of the upper base 66, and is moved by a different actuator from that for the upper base 66. On the other end portion of the slider 90 a block 92 is secured, to which a rotary plate 96 is attached via a bearing 94. On the lower surface of the rotary plate 96 both the preliminary flange forming die 70 and the flange forming die 78 are secured. Owing to rotation of the rotary plate 96, which is actuated by a hydraulic motor 98 fixed on the block 92 with a bracket 97 by way of a pinion 100 and a gear 102, either the die 70 or the die 78 is selectively positioned right on the axial line of the slider 90, i.e., just above a not-shown semi-finished article.

In this apparatus, the slider 90 and the upper base 66 are lowered in unison, while the slider 90 is being lowered in relation to the upper base 66 and the preliminary flange forming die 70 is being positioned above the axis of the slider 90, so as to perform the formation of the preliminary flange. And thereafter the slider 90 is raised together with the preliminary flange forming die 70 while the upper base 66 is being retained at its lowered position, that is to say, while the semi-finished article is under restraint between the aforementioned punch assembly 43 and die blocks 48, 50, followed by a lateral recession of the die 70 from the right above position of the semi-finished article due to a rotation of the rotary plate 96 by a predetermined angle, for example 180° for allowing the flange forming die 78 instead to be moved to that place. The slider 90 is then lowered again in relation to the upper base 66 for executing the flange forming process. Raising in unison of the slider 90 and the upper base 66 ensues, followed by a rotation in a reversed direction to the previous one of the rotary plate 96 so as to make a replacement of the die 78 by the die 70. One cycle of the process is completed herewith.

Additionally speaking, it is permissible to make either one, located under the preliminary flange forming die 70 or the flange forming die 78, laterally movable, (when they are arranged one above the other). It is not necessarily required to make both dies (70, 78) movable.

It must be said that the present invention is applicable to any of other shell manufacturing processes, too, not being limited only to the shell forming for the above tripod type universal-joint, such as for a Double offset plunging joint, a Rzeppa joint, a Weiss joint, etc., so long as the shell is provided with a flange on one end thereof.

What is claimed is:

1. Manufacturing method for a tubular shell of a universal-joint for flexibly coupling a first rotary shaft to a second rotary shaft, said shell being adapted to be secured at a flange formed on one end thereof to said first rotary shaft and being provided at a suitable number of places inside thereof with grooves extending along the axis thereof for being engaged with engaging portions disposed on one end of said second rotary shaft which is to be inserted inside said shell from the other end thereof, said method comprising processes of:

groove formation wherein a hollow cylindrical blank is applied pressing in a radial direction for forming said plural grooves therein and forming at the same time a preliminary flange at one end of said cylindrical blank by expanding it into a funnel shape; and flange formation wherein said preliminary flange formed on a semi-finished article in said groove formation process is formed into a completed flange by a flange forming die, while holding said semi-finished article in a restrained status under pressure from either side, external and internal, by means of restraining dies.

2. Manufacturing method as set forth in claim 1, wherein said groove formation process comprising a step of inserting a first die inside said cylindrical blank, a step of inwardly advancing a plurality of die blocks of a second die disposed outside said cylindrical blank in a radial arrangement in a substantially perpendicular direction to the axis of said first die, and a step of inserting under pressure a preliminary flange forming die having a funnel shaped external periphery into an opening on one end of said cylindrical blank while said semi-finished article is formed between said first die and said advanced die blocks.

3. Manufacturing method as set forth in claim 1, wherein the holding step of said semi-finished article in a restrained status is performed by means of inserting an inside restraining die inside said article and urging a plurality of outside restraining die blocks to an external surface of said article in a substantially perpendicular direction to the axis thereof.

4. Manufacturing method as set forth in claim 2, wherein after the process of groove formation only the perliminary flange forming die is retracted, while said semi-finished article is restrained under pressure by said first die and said second die, and the flange forming die is advanced in place of the former for performing said flange forming process by means of employing said first die and said second die as the restraining dies.

5. A manufacturing apparatus for a tubular shell of a universal-joint for flexibly coupling a first rotary shaft to a second rotary shaft, said shell being adapted to be secured at a flange formed on one end thereof to said first rotary shaft and being provided at a suitable number of places inside thereof with grooves extending along the axis thereof for being engaged with engaging portions disposed on one end of said second rotary shaft which is to be inserted inside said shell from the other end thereof, said apparatus comprising:

(1) a groove and preliminary flange forming apparatus comprising (a) a first die to be inserted inside a hollow cylindrical blank and having a plurality of axially elongated recesses formed on an external circumference thereof with an equal interangular distance and a plurality of non-recessed portions remained between each adjacent pair of said recesses, circumferential configuration of said first die being corresponding to internal configuration of said shell, (b) a second die consisting of a plural die blocks radially arranged to surround said first die, said die blocks being radially movable and defining a space corresponding to an external configuration of said shell at the most inwardly advanced position thereof, (c) a preliminary flange forming die of a funnel shape convergent from a fixed end to a free end thereof, which is axially movable, and (d) actuating means for simultaneously advancing said die blocks and said preliminary flange forming die to make the former urge a side wall of said blank to said first die and to simultaneously make the latter expand one end of said blank to a preliminary flange of funnel shape for making said blank into a semi-finished article; and (2) a flange forming apparatus comprising (a) restraining dies holding said semi-finished article in a restrained status under pressure from either side, external and internal, except at said preliminary flange thereof, and (b) a flange forming die having a flat surface axially pressing said preliminary flange for forming the same into a completed flange perpendicular to the axis of said shell.

6. A manufacturing apparatus as set forth in claim 5, wherein said restraining dies are composed of an inside restraining die to be inserted inside said semi-finished article and a plurality of outside restraining dies disposed in a radial arrangement outside said inside restraining die and to be moved toward and away from said inside restraining die in a substantially perpendicular direction to the axis of said inside restraining die.

7. A manufacturing apparatus for a tubular shell of a universal-joint for flexibly coupling a first rotary shaft to a second rotary shaft, said shell being adapted to be secured at a flange formed on one end thereof to said first rotary shfat and being provided at a suitable number of places inside thereof with grooves extending along the axis thereof for being engaged with engaging portions disposed on one end of said second rotary shaft which is to be inserted inside said shell from the other end thereof, said apparatus comprising:

a first die to be inserted inside a hollow cylindrical blank and having a plurality of axially elongated recesses formed on an external circumference thereof with an equal interangular distance and a plurality of nonrecessed portions remained between each adjacent pair of said recesses, circumferential configuration of said first die being corresponding to internal configuration of said shell;

a second die consisting of a plural die blocks radially arranged to surround said first die, said die blocks being radially movable and defining a space corresponding to an external configuration of said shell at the most inwardly advanced position thereof;

a preliminary flange forming die of a funnel shape convergent from a fixed end to a free end thereof, which is axially movable;

first actuating means for simultaneously advancing said die blocks and said preliminary flange forming die to make the former urge a side wall of said blank to said first die and to simultaneously make the latter expand one end of said blank to a preliminary flange of funnel shape for making said shell into a semi-finished article;

a flange forming die having a flat surface to be axially urged to said preliminary flange and being axially movable, at least one of said preliminary flange forming die and said flange forming die being laterally movable; and second actuating means for axially retracting said preliminary flange forming die while holding said die blocks at said most inwardly advanced position for restraining said semi-finished article from either side, external and internal, in cooperation with said first die, laterally moving at least one of said preliminary flange forming die and said flange forming die, and axially advancing said flange forming die to form said preliminary flange into a completed flange perpendicular to the axis of said shell.

8. A manufacturing apparatus as set forth in claim 5, 6 or 7, wherein said die blocks include two kinds of die blocks, principal and auxiliary, the principal die blocks being located facing said axially elongated recesses for rendering the side wall of said blank inwardly projecting, the auxiliary die blocks being located facing said nonrecessed portions for urging the side wall of said blank thereto, and each of said principal and auxiliary die blocks is respectively fixed to a first movable cam and a second movable cam which are radially advanced toward said first die respectively by a first complementary cam and a second complementary cam axially advanced together with said preliminary flange forming die, said first movable cam and said first complementary cam being engaged at cam surfaces thereof inclined against movement direction of said preliminary flange forming die, said second movable cam and said second complementary cam being engaged at cam surfaces thereof inclined in smaller angle than those of said first movable cam and said first complementary cam.

* * * * *